US008536433B1

(12) United States Patent
Foster

(10) Patent No.: US 8,536,433 B1
(45) Date of Patent: Sep. 17, 2013

(54) WAIST BELT RIGID FRAME EQUIPMENT SUPPORT HARNESS

(76) Inventor: Richard L. Foster, Craig, CO (US)

( * ) Notice: Subject to any disclaimer, the term of this patent is extended or adjusted under 35 U.S.C. 154(b) by 279 days.

(21) Appl. No.: 13/072,406

(22) Filed: Mar. 25, 2011

Related U.S. Application Data

(60) Provisional application No. 61/341,808, filed on Apr. 3, 2010.

(51) Int. Cl.
*G10D 3/00* (2006.01)

(52) U.S. Cl.
USPC ..... 84/327

(58) Field of Classification Search
USPC ..... 84/327
See application file for complete search history.

(56) References Cited

U.S. PATENT DOCUMENTS

| | | | | | |
|---|---|---|---|---|---|
| 3,102,446 | A | | 9/1963 | Raleigh | |
| 3,371,570 | A | | 3/1968 | Lester | |
| 4,630,763 | A | * | 12/1986 | Friedman | 224/259 |
| 5,000,071 | A | | 3/1991 | Thomas | |
| 5,069,103 | A | | 12/1991 | Healy | |
| 5,332,137 | A | * | 7/1994 | Violette | 224/257 |
| 5,483,860 | A | | 1/1996 | Adams | |
| 5,772,091 | A | | 6/1998 | Lackner | |
| 5,817,961 | A | * | 10/1998 | Beck | 84/327 |
| 5,873,503 | A | | 2/1999 | Atherton | |
| D435,168 | S | * | 12/2000 | Momburg | D3/215 |
| 6,189,158 | B1 | | 2/2001 | Lehoux | |
| 6,198,031 | B1 | | 3/2001 | Jones | |
| 6,250,525 | B1 | | 6/2001 | Lehoux | |
| 7,009,097 | B1 | | 3/2006 | Terplivetz | |
| 7,062,794 | B2 | | 6/2006 | LeBlanc | |
| 7,169,992 | B1 | | 1/2007 | Kennon | |
| 7,282,631 | B2 | * | 10/2007 | Chou | 84/385 A |
| 7,371,951 | B1 | | 5/2008 | Brunzetti | |
| 7,375,269 | B2 | | 5/2008 | Perkins | |
| 7,385,125 | B2 | | 6/2008 | Motsenbocker | |
| D574,415 | S | | 8/2008 | Koskela | |
| 7,888,573 | B1 | * | 2/2011 | Darbon | 84/327 |
| 8,182,439 | B2 | * | 5/2012 | Glenn | 602/19 |
| 2007/0289430 | A1 | | 12/2007 | Gallagher | |
| 2009/0084245 | A1 | * | 4/2009 | Harbaugh et al. | 84/327 |

FOREIGN PATENT DOCUMENTS

| | | |
|---|---|---|
| DE | 4019416 | 7/1991 |
| GB | 2141282 | 12/1984 |

OTHER PUBLICATIONS

Neotech Straps, Slimline Classic Strap, http://www.neotechstraps.com/product/detail/?PRODUCT_ID=42&PRODUCT_SUB_ID . . . , 1/102010, USA.

* cited by examiner

*Primary Examiner* — Christopher Uhlir
(74) *Attorney, Agent, or Firm* — Patent Law Offices of Rick Martin, P.C

(57) ABSTRACT

The present invention describes a harness apparatus for supporting objects, specifically stringed musical instruments, such as guitars, that allows the weight of the object to be borne by the hips and waist of the wearer and not the wearer's back, shoulders, and/or neck. The apparatus possesses a shapeable, padded rigid frame component that is associated with and rises from a padded waist belt component. The apparatus is profoundly adjustable and can be used by males, females, left-handed and right-handed persons. Advantages to an apparatus such as this include a reduction in back, shoulder, and/or neck strain, discomfort and fatigue that is normally associated with load supporting devices that bear the load's weight from the wearer's upper body. An equipment strap support loop is located on top of the inverted T frame. This support loop functions to replace the human neck and shoulders to support the equipment support strap.

8 Claims, 24 Drawing Sheets

23
28

25
26
21
24
20
22
F
34
30
LH
32

WAIST BELT RIGID FRAME EQUIPMENT SUPPORT HARNESS

CROSS REFERENCE APPLICATIONS

This application is a non-provisional application claiming the benefits of provisional application No. 61/341,808 filed Apr. 3, 2010.

FIELD OF INVENTION

The present invention relates to equipment and musical instrument support devices that use the hips to support the weight, specifically those devices designed to be worn by a musician.

BACKGROUND OF THE INVENTION

There exist quite a large number of wearable musical instrument and equipment support devices available today. Patent numbers DE4019416, 5,873,503, and 5,483,860 to Al Liebchen 2000, Atherton, et al. 1999 and Adams 1996 respectively, detail a number of wearable, load bearing devices, which distribute the load over some portion of the operator's back, shoulders and/or neck but still utilize the operator's or musician's back, shoulders and/or neck to bear the weight. Everyone who has ever been in the position of having to bear a weight supported by their back, shoulders, and/or neck for an extended period of time has come to know first-hand how pain, discomfort and fatigue can develop. This discomfort, for an extended period of time, can lead to a potential disability and/or back problem that is immediate or can develop later in life. A solution reducing these issues would be a device that bears the weight at the hips and waist as does the present invention.

There are a number of issued patents that support the weight of a carried load from the hips and waist of an operator, those being patent numbers U.S. Pat. Nos. 7,009,097, 5,332,137, 5,069,103, 3,102,446, and 5,000,071, to Terplivetz 2006, Violette 1994, Healy 1991, Raleigh 1963, and Thomas 1991 respectively. Interestingly, all of these patents present tremendous limitations that associate with the capacity to position the equipment or instrument while in use with essentially single point attachments of the instrument to the carry apparatus. Musical instrument players generally have their favorite positions for the instrument to be placed. It clearly remains more desirable to have the option of adjustment for comfort and ease of use, and the present invention provides profound instrument adjustability not only in the vertical axis but the horizontal as well.

Additionally, there are a number of issued patents that require modification to an instrument in order for the lifting and bearing mechanism to function. U.S. Pats. DE4019416, 7,009,097, 5,332,137, 5,069,103, 3,102,446, and 3,371,570 to Terplivetz 2006, Violette 1994 Healy 1991, Raleigh 1963, and Lester 1967 respectively, as well as patent Applied For application Ser. No. 11/557,984 Gallagher 2006—Publication number US 2007/0289430A1 Gallagher Dec. 20, 2007, clearly outline the modifications required to inflict upon an instrument for means of attachment. In so doing the process can profoundly compromise the value of the instrument. It remains clearly apparent that there is a profound need for a lifting and bearing mechanism that transfers the weight of an instrument to the hips and waist of the user, offers profound lateral and vertical adjustment of the carried article, and does so in a manner that utilizes the conventional attachment means already existing upon what is being borne. The present invention does just that and in a manner that remains reversible so as to be usable by both left-handed and right-handed people, and fully functional for a man or a woman. Further advantages will become apparent throughout the remainder of this work.

SUMMARY OF THE INVENTION

The primary aspect of the present invention is:

a) to provide a rigid frame component that is mechanically associated with a waist belt, a chest strap, and a stringed instrument strap;
b) to provide a means by which the borne instrument's weight is supported by the waist and hips rather than by the back, shoulders, and/or neck;
c) to provide a means of supporting the instrument without requiring any modifications to the equipment that might diminish the instrument's value;
d) to provide substantial adjustability so that it can be used by people of all sizes and shapes and by males and females;
e) to provide reversibility so as to be usable by both left-handed and right-handed users
f) to provide substantial adjustability in all dimensions so that the instrument is able to be placed in a position of the user's choosing rather than the user adapting to a position dictated by the support device;
g) to provide padding features to protect the borne instrument from excessive wear; and
h) to provide padding features to enhance the comfort of the user.

In accordance with one embodiment an inverted T waist belt, rigid frame equipment support harness comprises a shapeable rigid frame component having a capacity to support the borne instrument or equipment without requiring any modification to the instrument. This rigid frame component mechanically associates with a waist belt component, a chest strap component and an instrument strap component, all of which contribute to the function of placing the instrument's total weight on the waist and hips. Also, all of these components are adjustable and reversible so as to individually and collectively offer both left-handed and right-handed users a wide range of positions in which the instrument can be placed. Further, the components utilize padding features so as to protect the instrument from excessive wear and to enhance the comfort to the user.

Other aspects of this invention will appear from the following description and appended claims, reference being made to the accompanying drawings forming a part of this specification wherein like reference characters designate corresponding parts in the several views.

Figure 1:
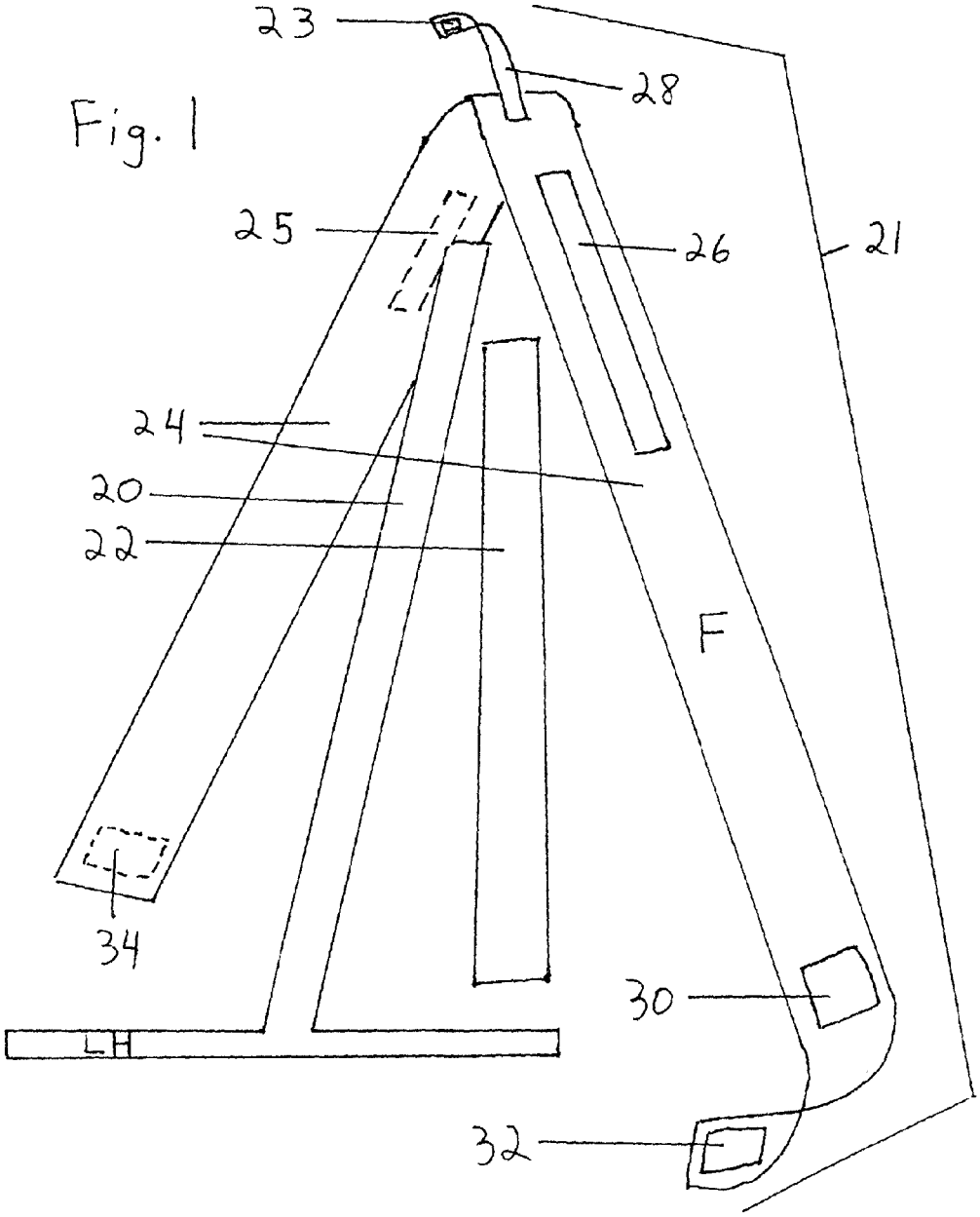
FIG. 1 is an exploded view of the preferred embodiment of the shapeable rigid frame inverted T frame.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

In the drawings, removably entangling hook and loop fastener pads will be referenced hook and loop or abbreviated "H-L, Hook H-L, or "Loop H-L". For each hook and loop closure, any pairing of the hook side and the loop side will provide the proper function. There are positions/locations where use of the hook component might cause unnecessary abrasion to the instrument or inconvenience to the user. In these locations use of the loop component is recommended. These hook and loop locations are 25, 26, 29, 30, 34, 46, and 57. Also in this document, for brevity, the term buckle is used to mean any adjustable quick-attachment/quick-release fastener. Also, the process of "sewing" as described in this document can also mean to attach by any suitable means. Lastly, the term "guitar" is used to mean any stringed musical instrument that is held when it is played.

DRAWINGS

Reference Numerals

20 shapeable rigid inverted "T" frame
21 padded rigid inverted "T" frame
22 "T" frame padding
23 hook and loop location
24 "T" frame webbing
25 hook and loop location
26 "T" frame hook and loop location
27 hook and loop location
28 equipment strap loop-adjustable
29 hook and loop location
30 "T" frame hook and loop location
32 "T" frame hook and loop location
33 belt opening
34 "T" frame hook and loop location
35 waist belt
36 waist belt webbing
37 waist belt padded extension
38 waist belt padding
39 hook and loop location
40 frame cradle padding
41 hook and loop location
42 frame cradle webbing
43 waist belt padded extension webbing
44 waist belt webbing hook and loop location
46 waist belt webbing hook and loop location
47 waist belt padded extension padding
48 hook and loop location
49 hook and loop location
50 hook and loop location
51 hook and loop location
52L buckle left half
52R buckle right half
53 chest strap
54 chest strap webbing
55 hook and loop location
56 chest strap padding
57 hook and loop location
58 hook and loop location
60 hook and loop location
61 chest strap padded extension
62 hook and loop location
63 chest strap padded extension webbing
64 chest strap rigid strut
65 chest strap padded extension padding
66 hook and loop location
67 hook and loop location
68 hook and loop location
69 hook and loop location
70L chest strap buckle left half
70R chest strap buckle right half
72 stringed instrument strap webbing-lower
73 stringed instrument strap
74 stringed instrument strap loop-lower
76 stringed instrument strap webbing-upper
78 stringed instrument strap loop-upper
80 positionable buckle
86 stringed instrument strap knob upper
88 stringed instrument strap knob lower
90 stringed instrument
98 harness main assembly
100 user/operator
110 saxophone strap
112 saxophone strap webbing
114 saxophone attachment hook
116 hook and loop location
118 hook and loop location
120 vendor tray strap assembly
122 tray strap webbing piece
123 tray strap webbing piece 2

124 tray strap buckle
126 money pouch assembly
128 vendor tray
130 rigid strut-money pouch
132 hook and loop location
134 hook and loop location
136 hook and loop location
138 hook and loop location
140 fabric exterior-money pouch
142 fabric interior-money pouch
150 misc. strap
152 misc. strap webbing
154 misc. strap buckle
350 basic waist belt
530 basic chest strap
980 basic harness main assembly FIG. 1 presents the disassembled, open view details of the preferred embodiment of inverted T frame assembly 21. Hook and loop component 23 is sewn onto equipment strap loop 28. Equipment strap loop 28 along with hook and loop components at positions 25,26,30,31, 32 and 34 are sewn into webbing piece 24. Additionally, padding 22 as well as the vertical portion of T frame 20 is enclosed by stitching into webbing 24 as hook and loop components at positions 32 and 34 interlock to hold the assembly. Padding 22 is installed between vertical element of T frame 20 and webbing piece 24 so as to face the front F of the frame to protect to guitar.

Figure 2:
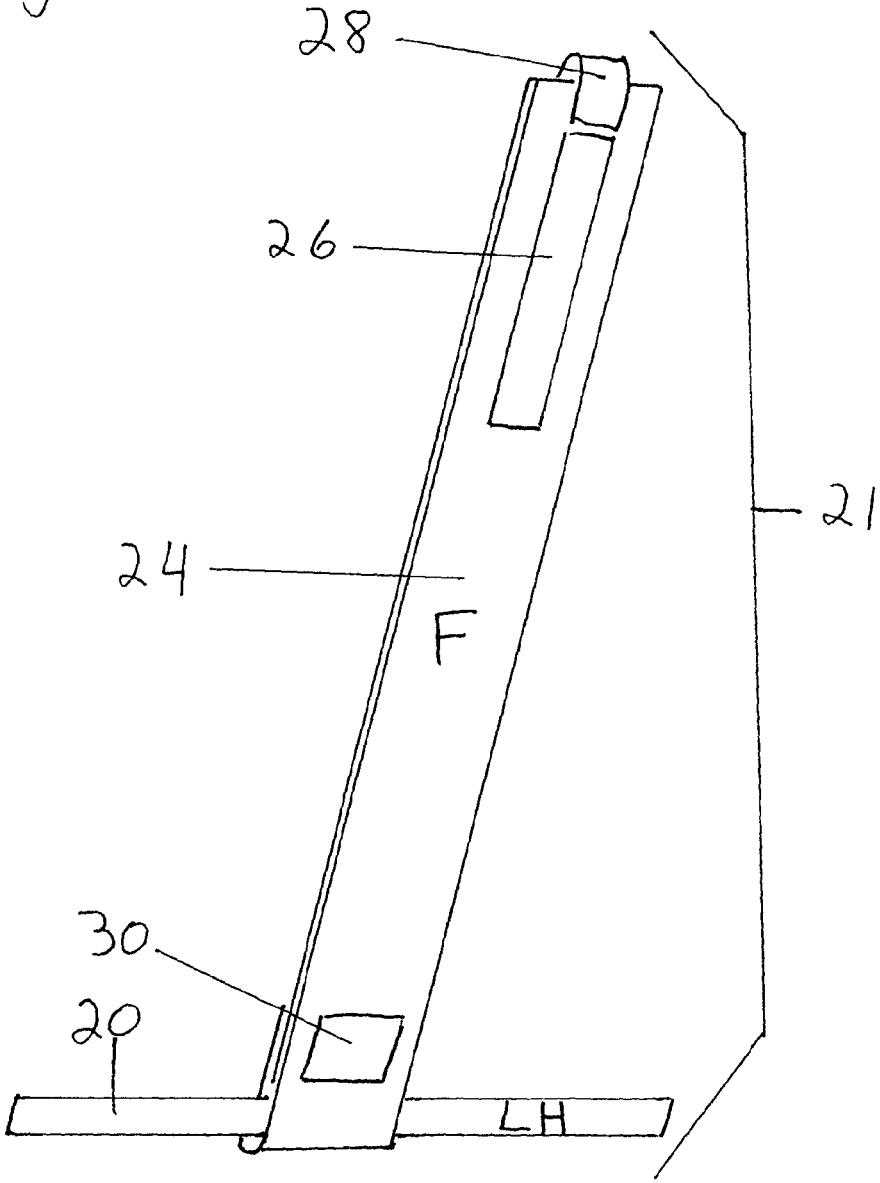
FIG. 2 is a rear perspective view of a partially assembled inverted "T" frame.

Examination of FIG. 2 conveys the assembled appearance of inverted T frame assembly 21. Notice that padding 22 (FIG. 1) remains non-visible as it has been entrapped within webbing piece 24 by stitching, and the only remaining visible portion of inverted T frame 20 is the lower horizontal LH portion which protrudes laterally.

Figure 3A:
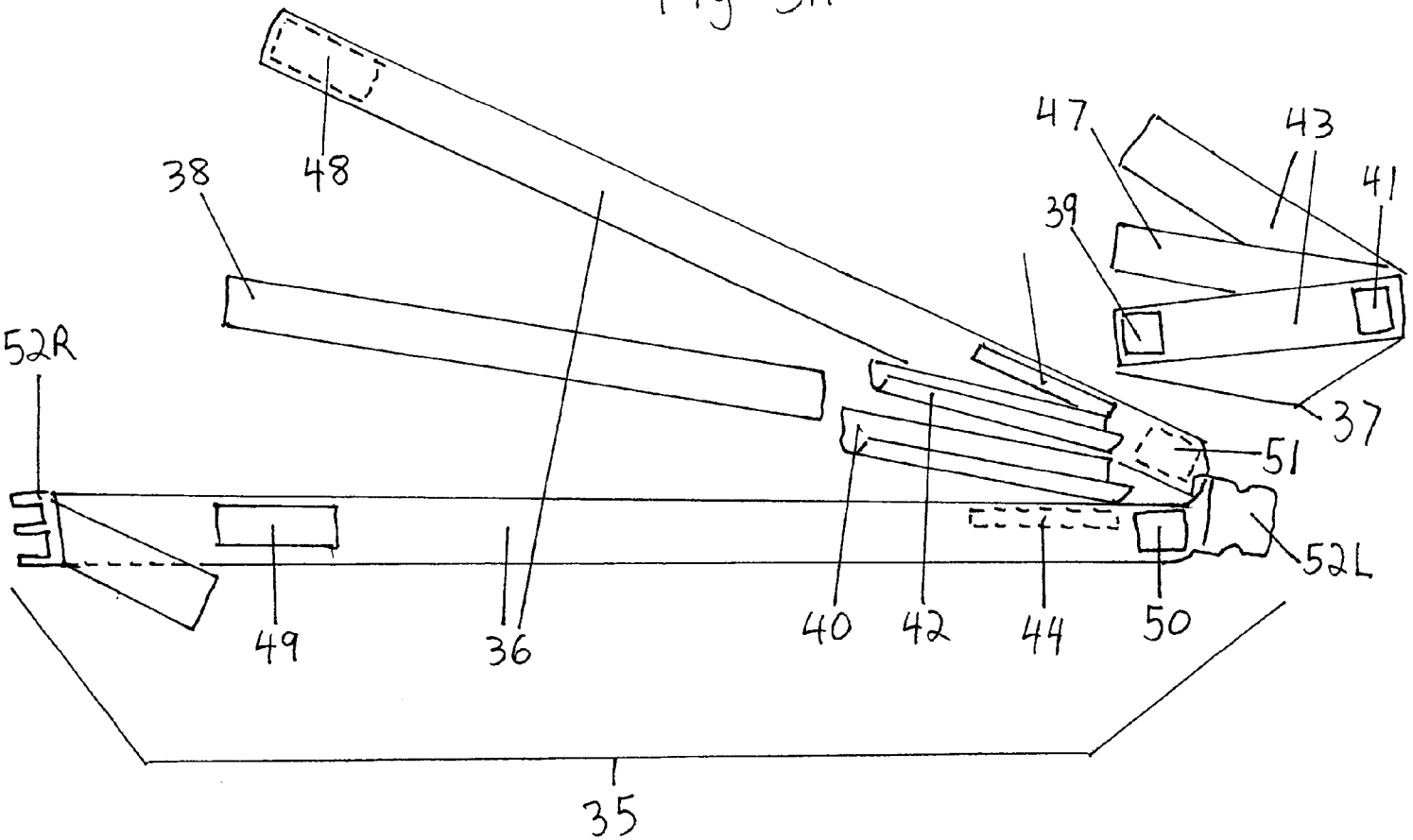
FIG. 3A is an exploded view of the waist belt and waist belt padded extension.
Figure 3B:
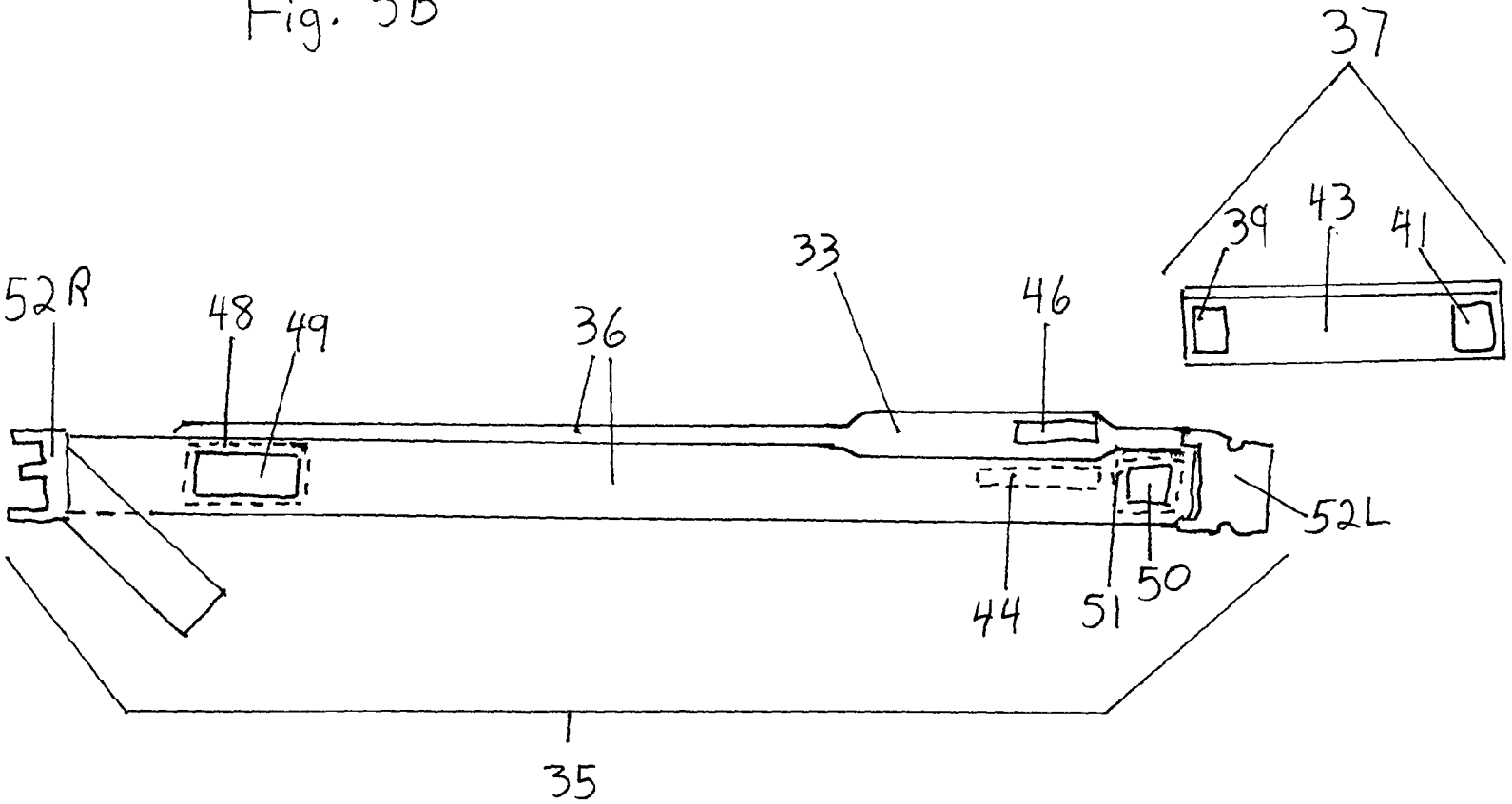
FIG. 3B is a front elevation view of the assembled waist belt and waist belt padded extension with buckle on user's left side (as used by a right-handed guitar player).

FIGS. 3A and 3B present detailed versions of both disassembled and assembled views of waist belt 35 and waist belt padded extension 37. Examination of FIG. 3A reveals waist belt webbing segment 36 terminating on both ends with connection buckle components 52R and 52L.

Detachable waist belt padded extension 37 is shown in a disassembled manner clearly exposing waist belt padded extension webbing 43, waist belt padded extension padding 47, enclosed within padded extension and hook and loop attachment locations 39 and 41 which attach as needed to hook and loop locations 48 and 49 on waist belt webbing piece 36. Frame cradle webbing 42 functions as abrasion resistance surfacing for frame cradle padding 40 which is sewn into the two halves of waist belt webbing 36 along with waist belt padding 38.

FIG. 3B presents assembled waist belt 35 as described above specifically for right handed use displaying the role of hook and loop locations 48,49,50 and 51 and how they associate with locations 39 and 41 in the attachment of waist belt padded extension 37. Additionally, hook and loop location 46 associates with hook and loop location 44 inside strap 36 and function to retain shapeable rigid inverted "T" frame assembly 21 (FIG. 1) which is inserted into strap opening 33.

Figure 3C:
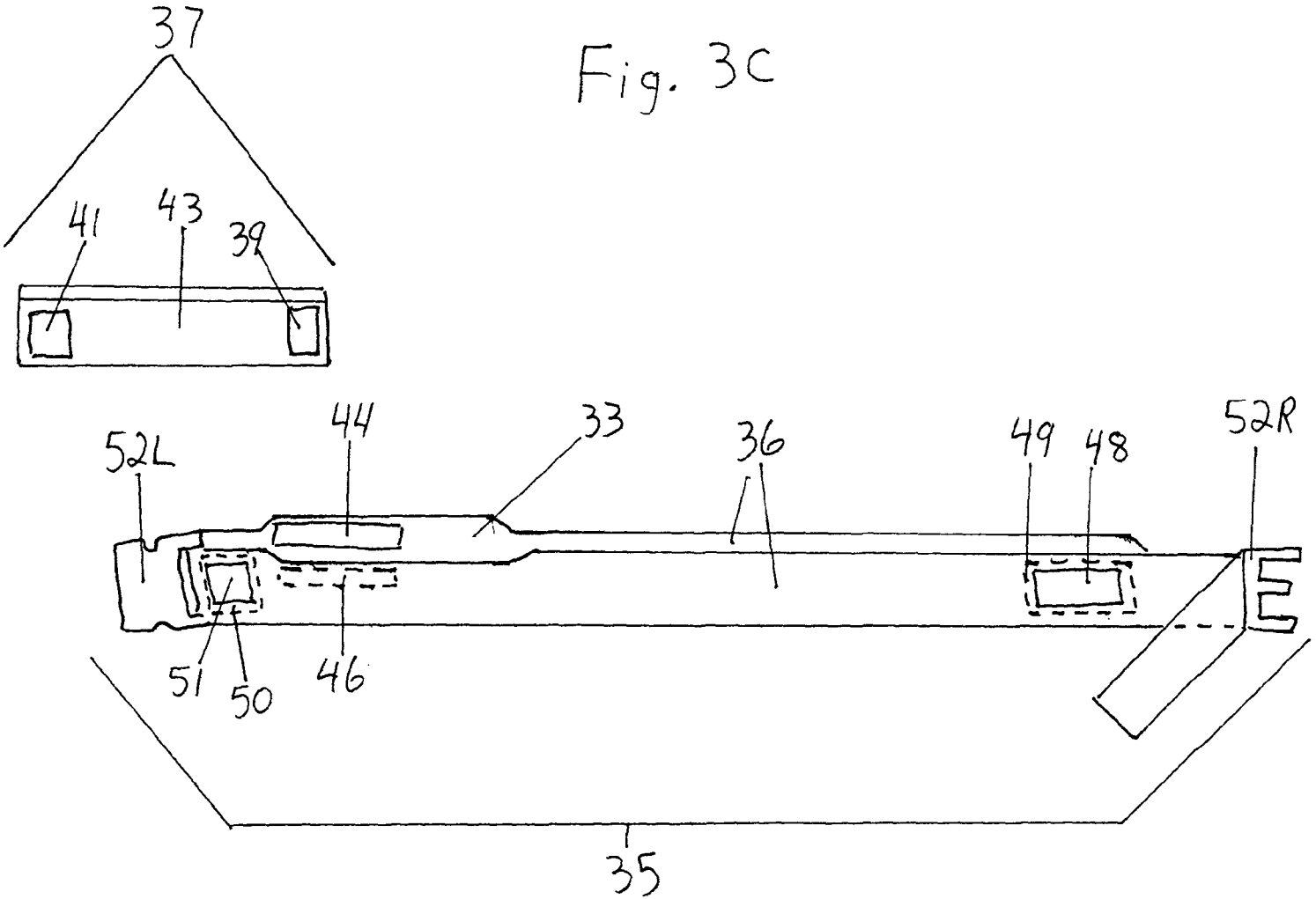
FIG. 3C is a front elevation view of the assembled waist belt and waist belt padded extension with buckle on user's right side (as used by a left-handed guitar player).

FIG. 3C presents the same waist belt assembly 35 as shown in FIG. 3*b* only in reverse, thus affording the entire system the universal appeal of reversibility for right or left handed use.

Figure 4A:
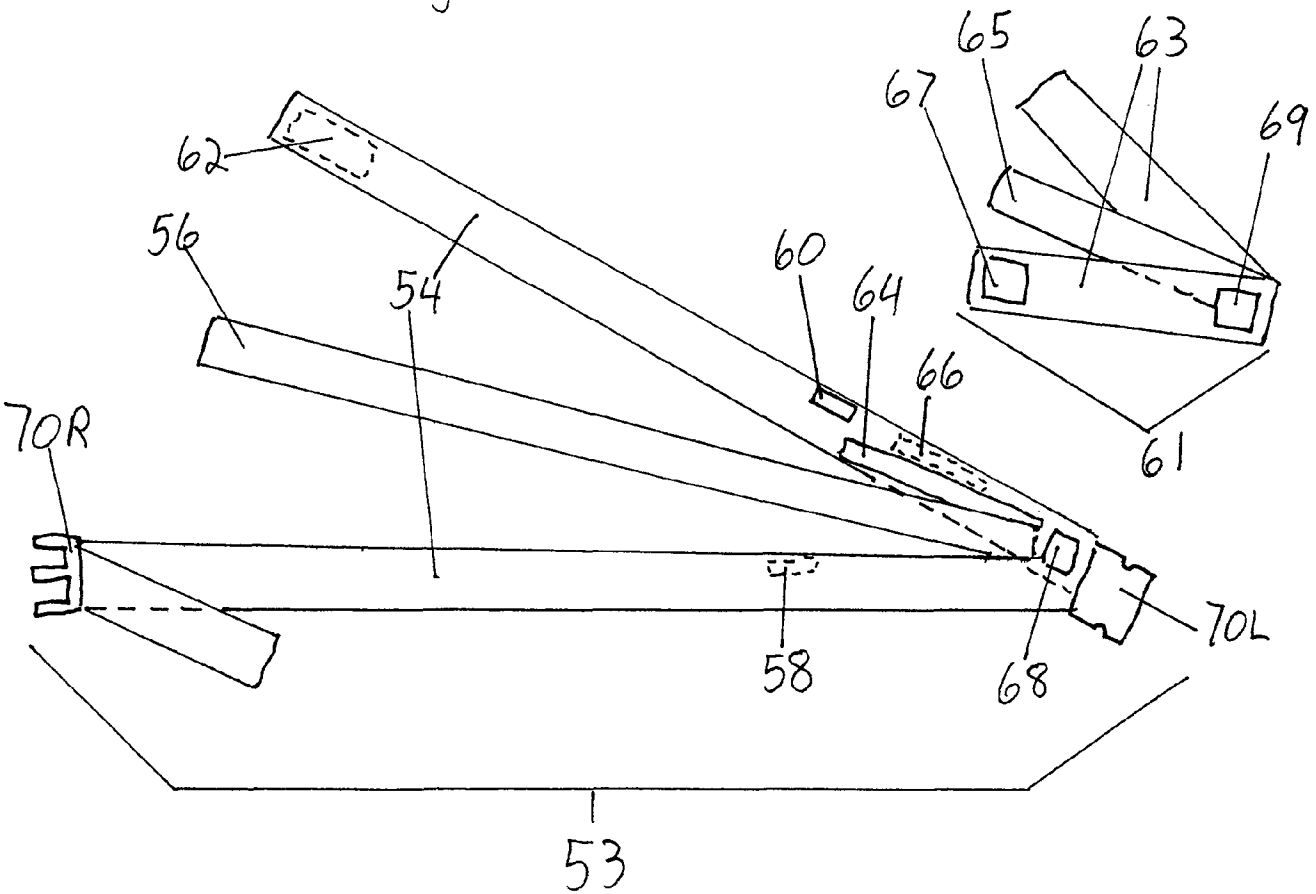
FIG. 4A is an exploded view of the chest strap and chest strap padded extension

FIG. 4A presents the disassembled/open view of chest strap 53 and chest strap padded extension 61. The components of chest strap 53 comprise chest strap webbing 54, padding 56, hook and loop locations 60,62,68 which associate with hook and loop locations, 58, 67, 69 respectively, buckle halves 70R, 70L, and a shapeable rigid strut 64 which is enclosed within webbing piece 54. Hook and loop location 66 is sewn onto chest strap webbing 54. The make up of chest strap padded extension 61 is clearly visible as webbing 63 encases padding 65. Hook and loop locations 67 and 69 will logically associate with hook and loop locations 62 and 68 on waist belt 53.

Figure 4B:
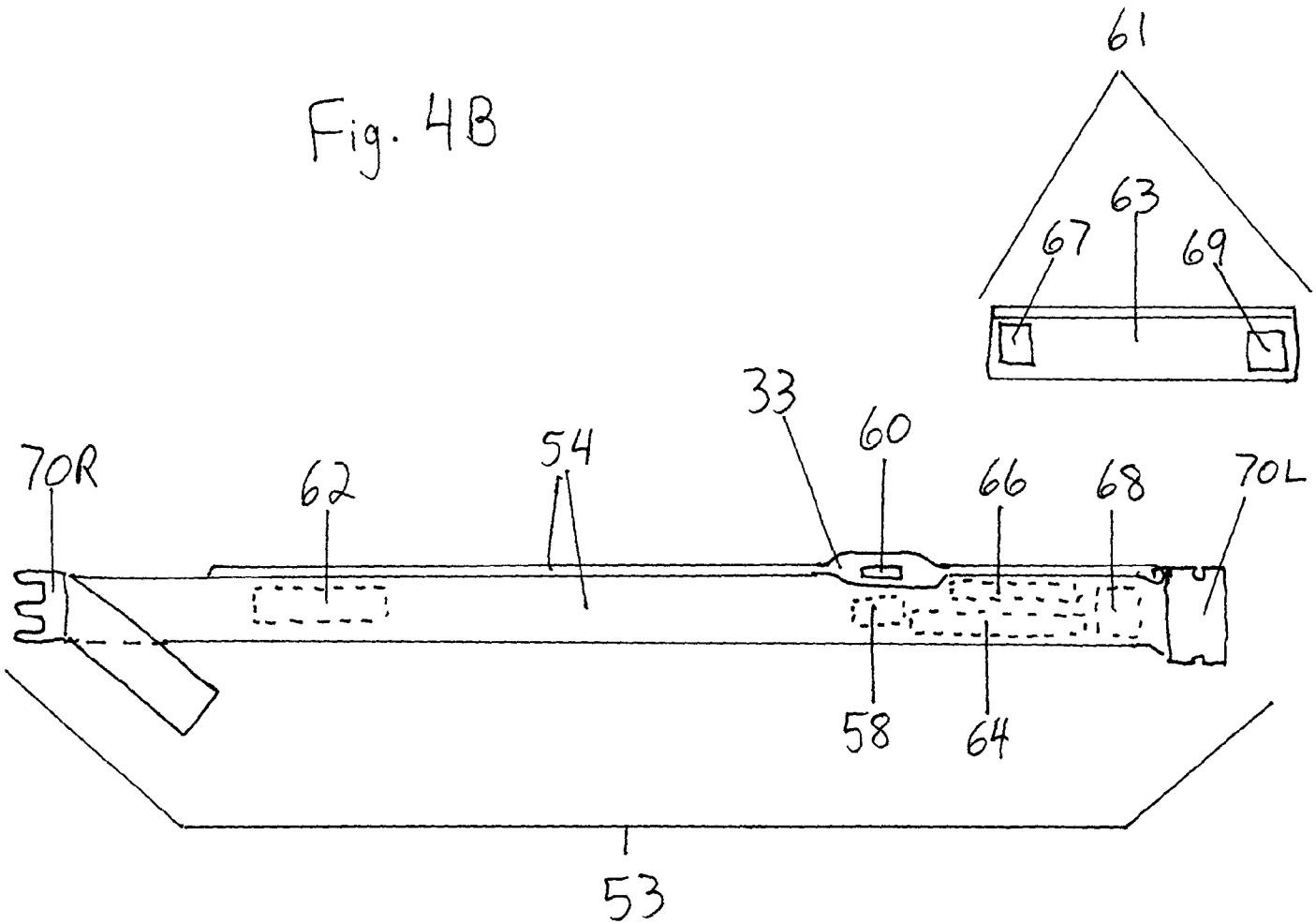
FIG. 4B is a front elevation view of the chest strap and chest strap padded extension.

FIG. 4B shows assembled/closed view of chest strap 53 and chest strap padded extension 61. Chest strap as shown displays buckles 70R and 70L terminating chest strap 53 and logically are used to link chest strap into a circle around user's chest. Within chest strap webbing 54 is hidden chest strap rigid strut 64 which is held in position by hook and loop locations 60 and 58. Chest strap rigid strut 64 can be inserted or removed through strap opening 33 which is created when hook and loop locations 58 and 60 are disassociated.

Figure 5A:
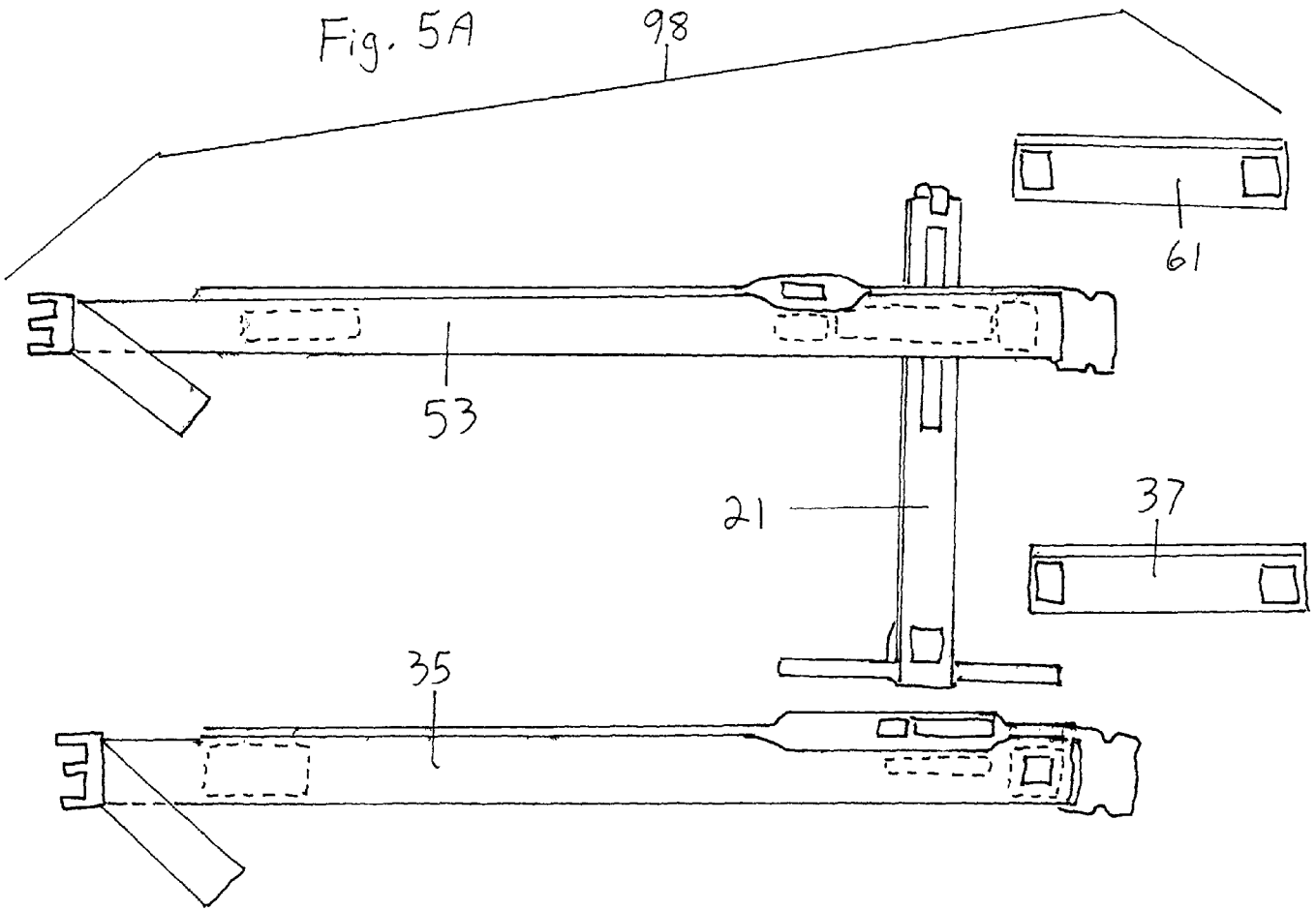
FIG. 5A is an exploded view of the harness main assembly.

FIG. 5A presents the components of harness main assembly 98 positioned for assembly. The five components shown are waist belt 35, waist belt padded extension 37, padded rigid inverted "T" frame 21, chest strap 53 and chest strap padded extension 61.

Figure 5B:
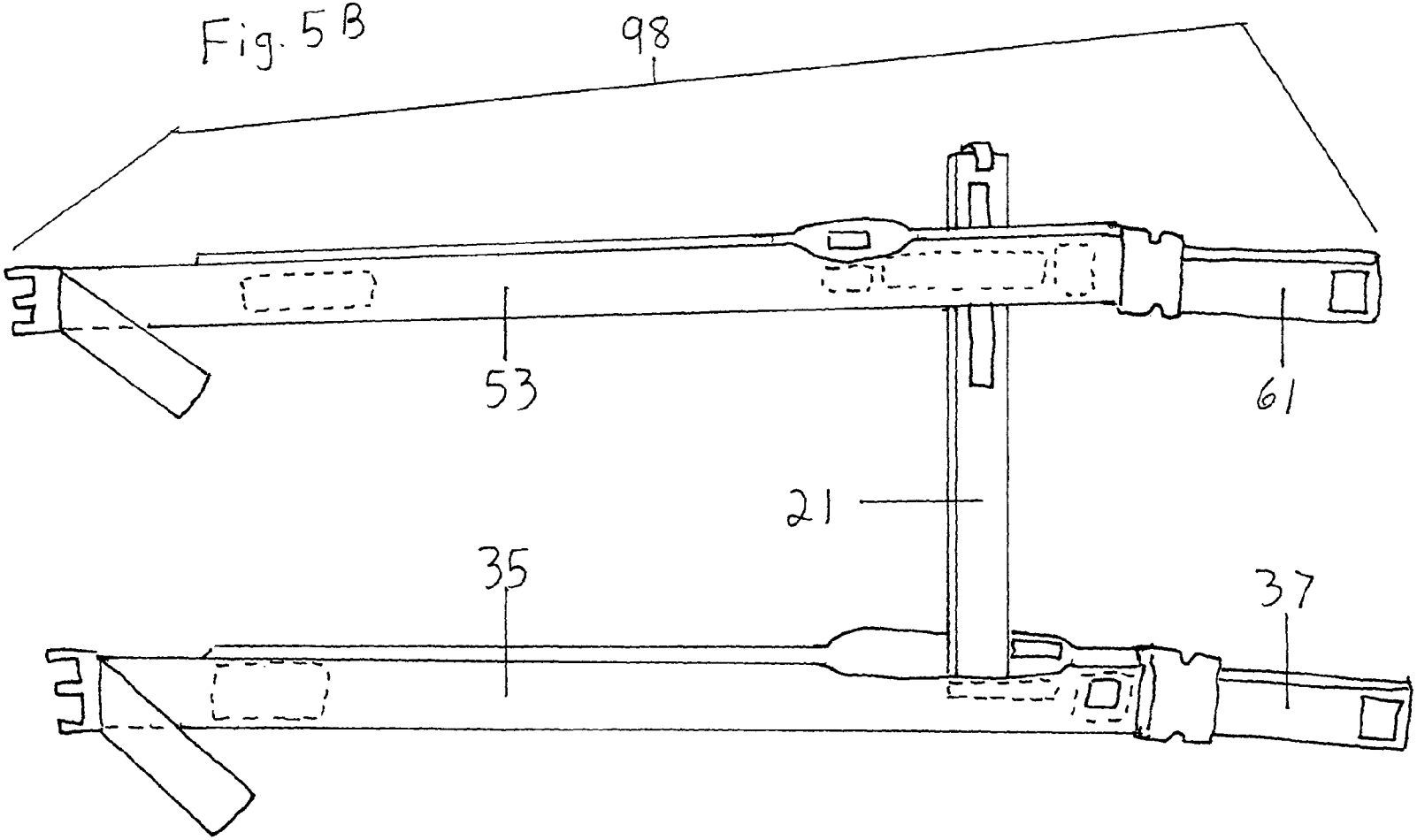
FIG. 5B is a front elevation view of the assembled harness main assembly.

FIG. 5B presents the completely assembled harness 98. Note attachment of extensions 37 and 61 are installed behind buckles 52L and 70L, respectively, and function to pad the user from discomfort while in use. Upon installation, buckle halves 70R and 70L attach to one another, and buckle halves 52R and 52L attach to one another thus encircling the user. Next, the installation of the two padded extensions can be completed. The installation of waist belt padded extension 37 is accomplished by attaching hook and loop locations 39 and 41 to hook and loop locations 50 and 49, respectively. Likewise, the installation of chest strap padded extension 53 is accomplished by attaching hook and loop locations 67 and 69 to hook and loop locations 68 and 62, respectively.

Figure 5C:
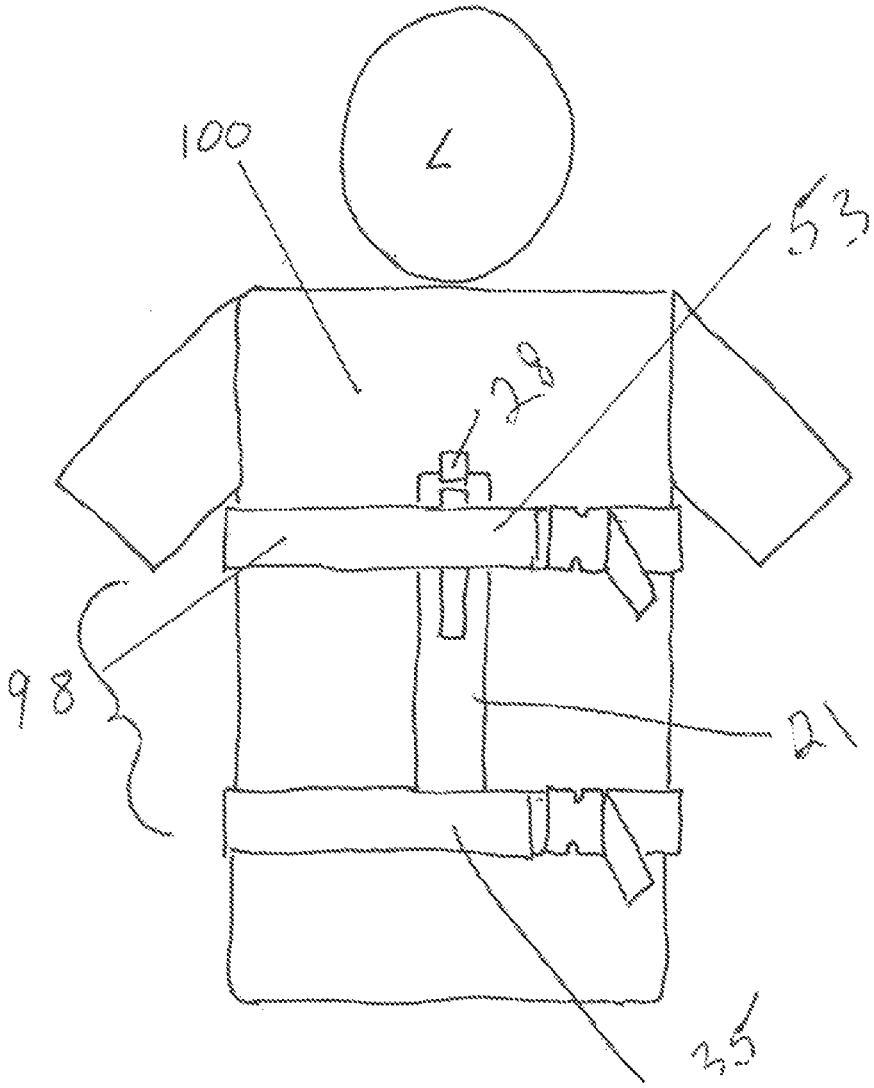
FIG. 5C is a front elevation view of the assembled harness main assembly worn by a user.

FIG. 5C presents the completely assembled harness main assembly 98 installed on user 100.

Figure 6A:
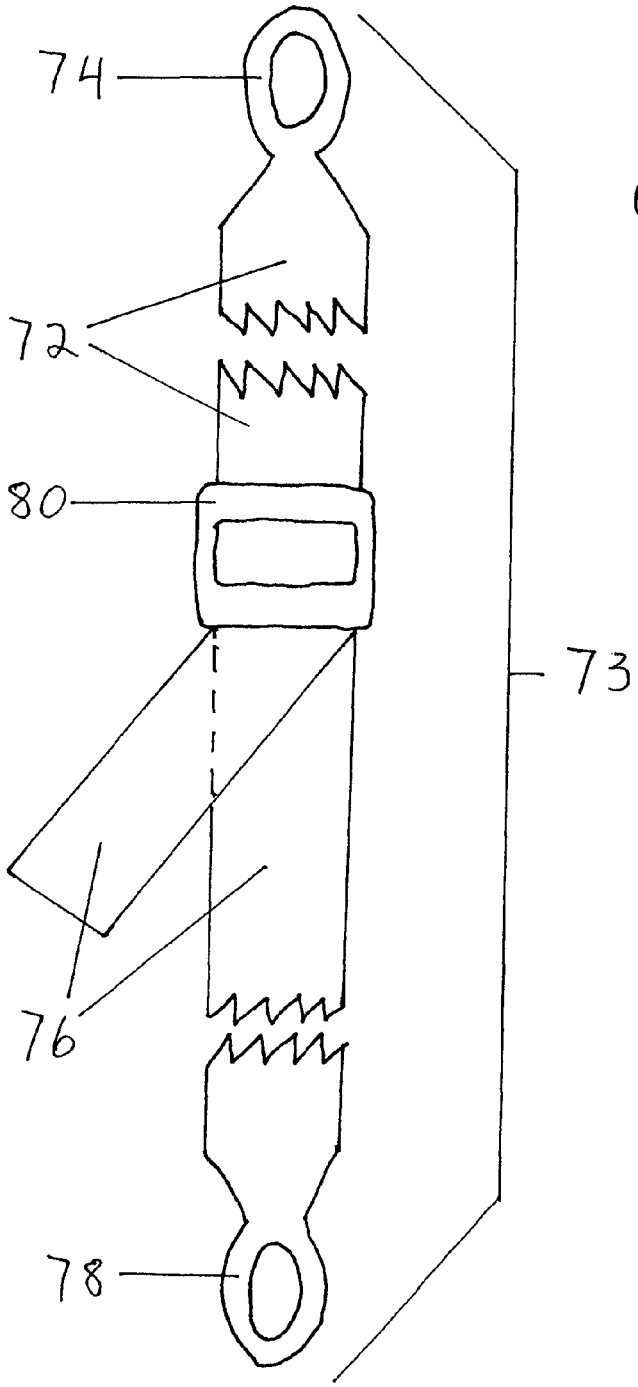
Fig. 6A (Prior Art)
FIG. 6A (prior art) is a front elevation view of a stringed instrument strap.

FIG. 6A presents stringed instrument strap 73. Stringed instrument strap webbing-lower 72 is sewn into stringed instrument strap loop-lower 74 at the first end, with the second end terminating securely into buckle 80. Stringed instrument strap webbing-upper 76 is sewn into stringed instrument strap loop-upper 78 on the first end and the second end is adjustably terminated into buckle 80.

Figure 6B:
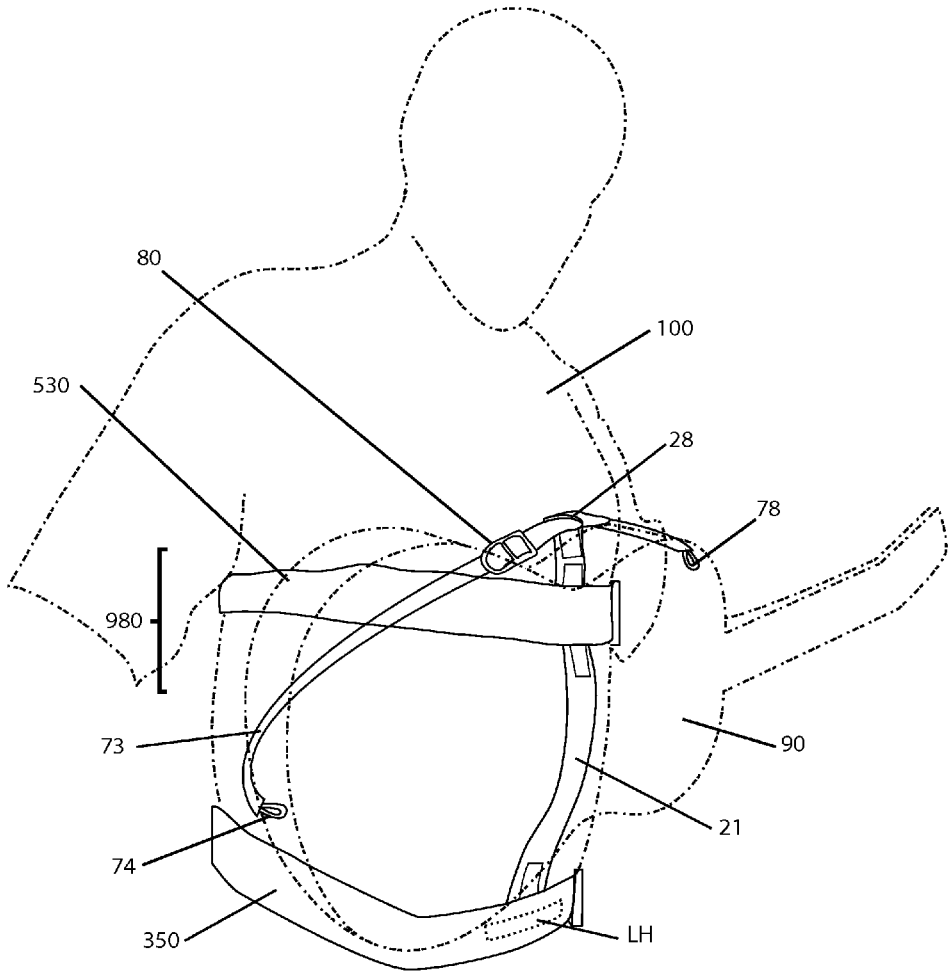
FIG. 6B is a front elevation view of the stringed instrument strap attached to the harness main assembly and supporting a guitar.

FIG. 6B displays in detail, harness main assembly 98 in use. Stringed instrument 90 hangs from stringed instrument strap 73 adjustably tightened by buckle 80 terminating on the upper end at upper stringed instrument strap knob 86 and at the lower end at lower stringed instrument strap knob 88. Equipment loop strap 28 supports stringed instrument strap 73.

Figure 7A:
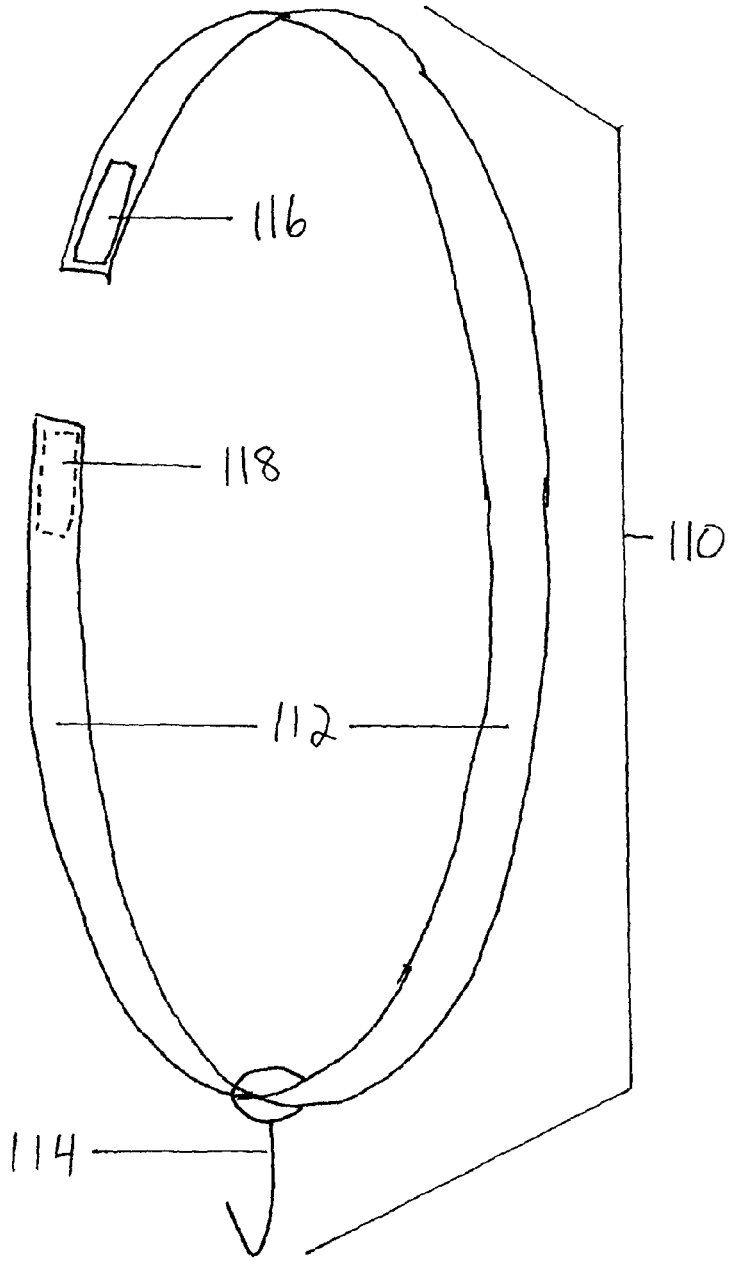
FIG. 7A (prior art) is a front perspective view of an assembled saxophone strap.

FIG. 7A presents assembled view of saxophone strap 110, the components of which are hook and loop locations 116 and 118 and saxophone strap webbing 112 which is placed through ring end of saxophone hook 114.

Figure 7B:
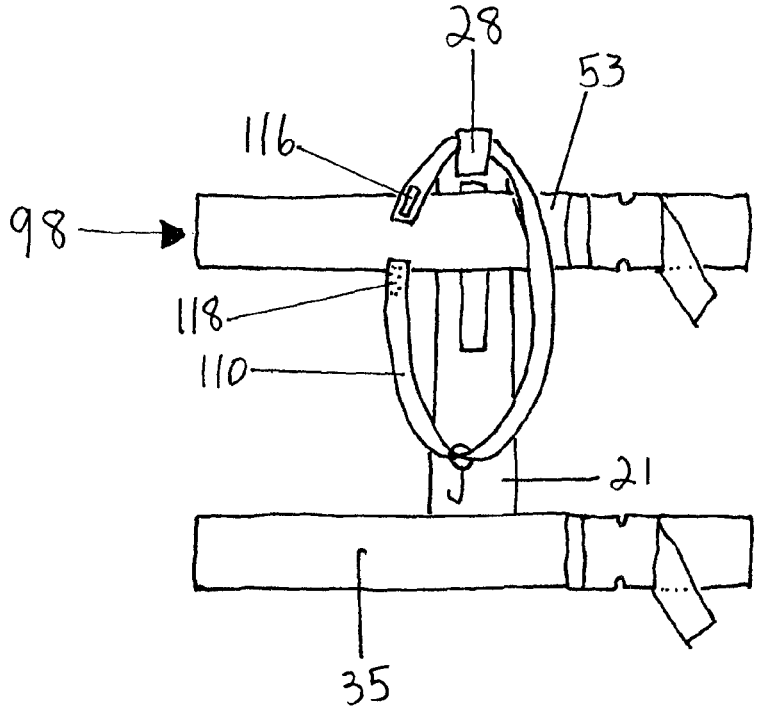
FIG. 7B is a front elevation view of the saxophone strap attached to the harness main assembly.

FIG. 7B shows saxophone strap 110 installed onto harness main assembly 98, which is accomplished by threading saxophone strap 110 through equipment strap loop 28 and attaching together hook and loop locations 116 and 118.

Figure 8A:
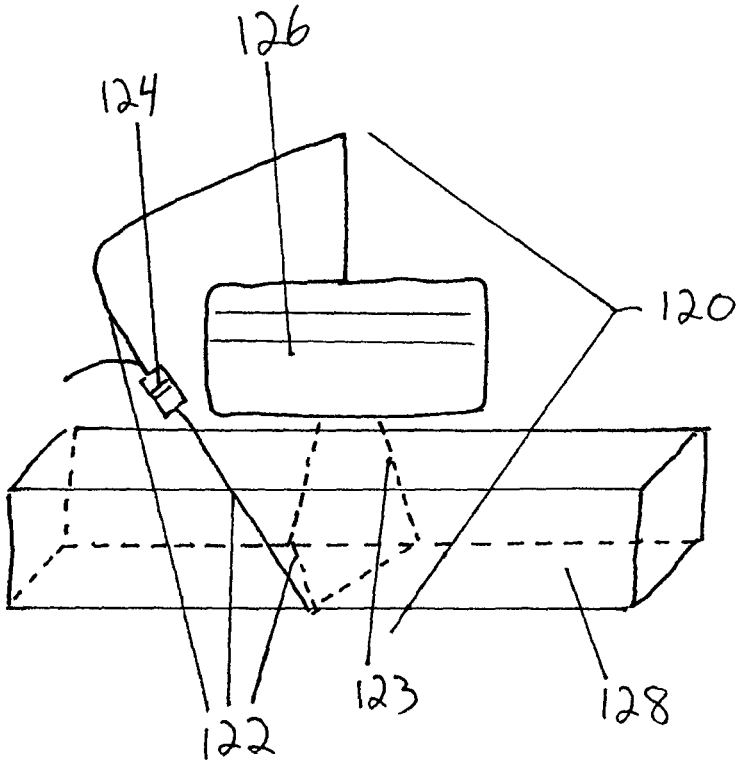
FIG. 8A is a front elevation view of a vendor tray strap assembly supporting vendor tray and money pouch assembly.

FIG. 8A shows vendor tray strap assembly 120, components of which are vendor tray strap webbing 122 and 123, tray strap buckle 124, and money pouch assembly 126. Also shown is vendor tray 128 to illustrate how vendor tray strap assembly 120 supports it.

Figure 8B:
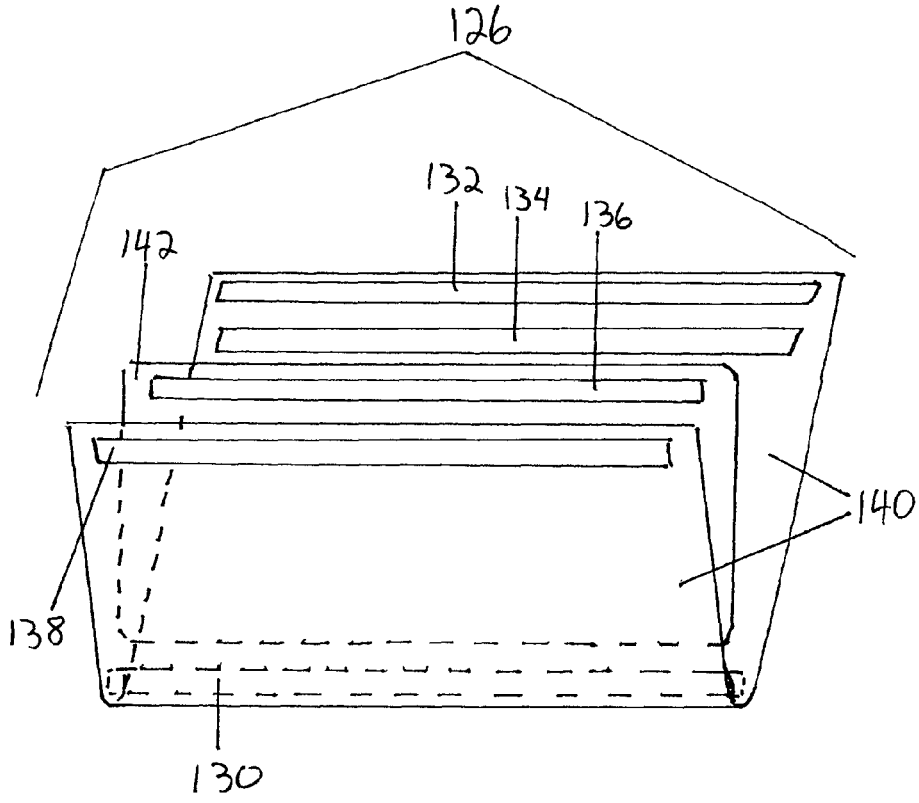
FIG. 8B is a front perspective view of the money pouch assembly shown in FIG. 8A.

FIG. 8B is a detailed illustration of money pouch assembly 126, the components of which are fabric exterior-money pouch 140, fabric interior-money pouch 142, hook and loop locations 132, 134, 136, and 138, and rigid strut-money pouch 130.

Figure 8C:
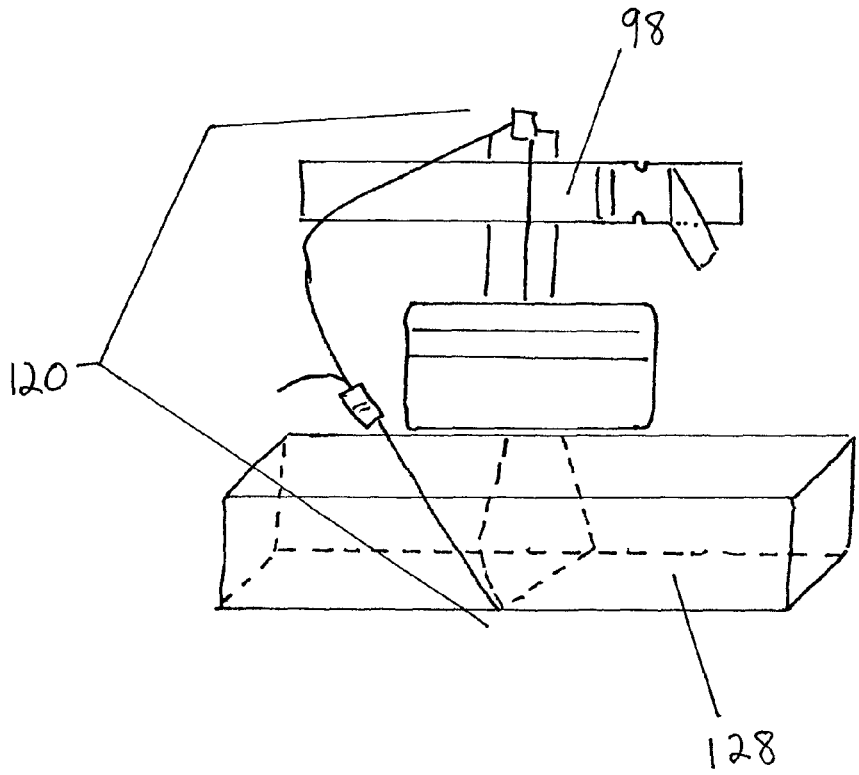
FIG. 8C is a front elevation view of the harness main assembly supporting vendor tray strap assembly, vendor tray, and money pouch assembly.

FIG. 8C shows harness main assembly 98 supporting vendor tray strap assembly 120 and vendor tray 128.

Figure 8D:
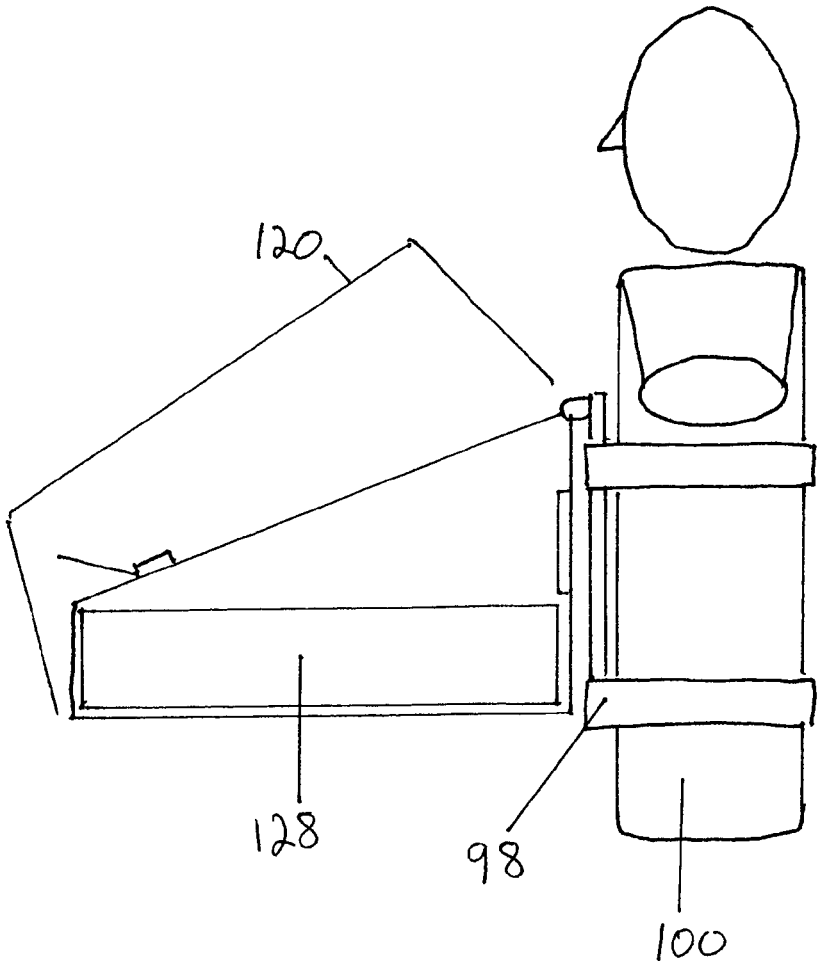
FIG. 8D is a right side elevation view of the user wearing the harness main assembly which supports the vendor tray strap assembly, vendor tray, and money pouch assembly.

FIG. 8D presents the left side view of vendor tray strap assembly 120 and vendor tray 128 as supported by harness main assembly 98, shown on body of user 100.

Figure 9:
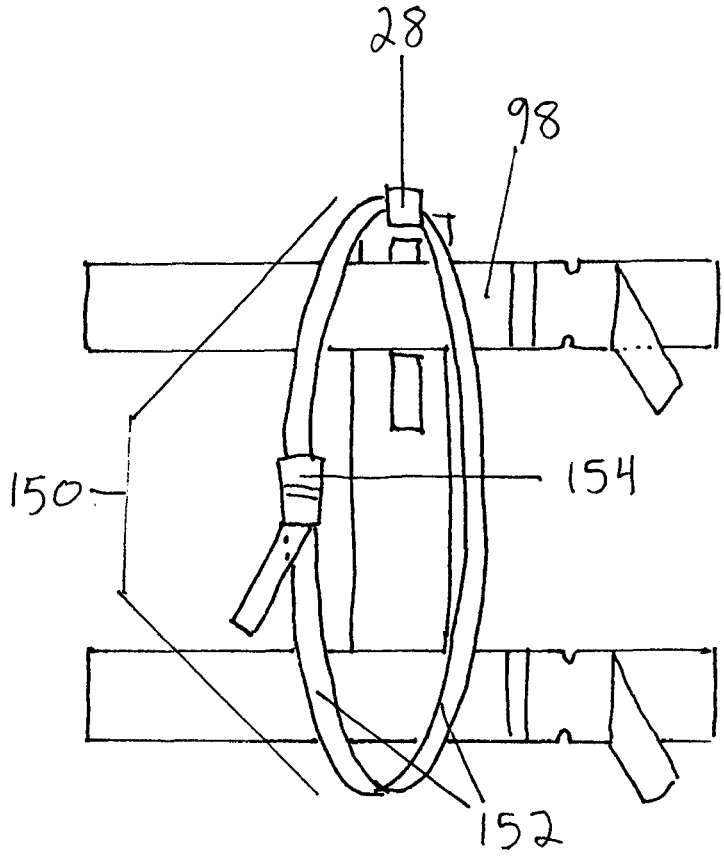
FIG. 9 is a front elevation view of the harness main assembly supporting a miscellaneous strap.

FIG. 9 illustrates harness main assembly 98 supporting miscellaneous strap 150, the components of which are miscellaneous strap webbing 152 and miscellaneous strap buckle 154. Miscellaneous strap 150 can be used to support a tuba, sousaphone, baritone horn, bass drum, etc.

Figure 10:
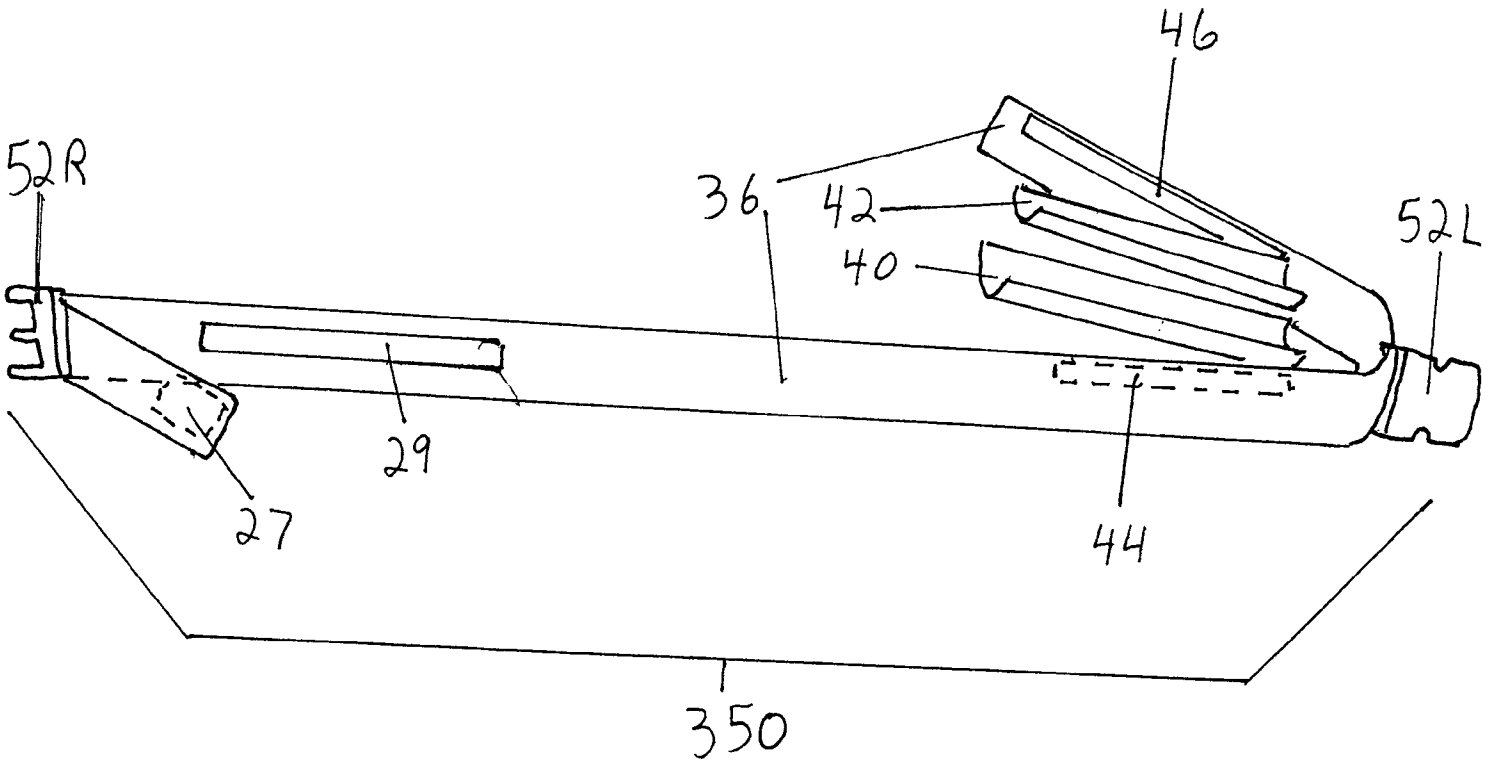
FIG. 10 is an exploded view of another embodiment of the waist belt.

FIG. 10 displays disassembled preferred embodiment of waist belt 350. Waist belt webbing 36 terminates on both ends with connection buckle components 52R and 52L. Frame cradle webbing 42 functions as abrasion resistance surfacing frame cradle padding 40 which is sewn into the two halves of waist belt webbing piece 36 along with waist belt padding 38. Hook and loop locations 44, 45, 46, 49 are sewn onto waist belt webbing 36. Hook and loop locations 44 and 46 are attached to form strap opening 33. Hook and loop locations 27 and 29 are attached together.

Figure 11:
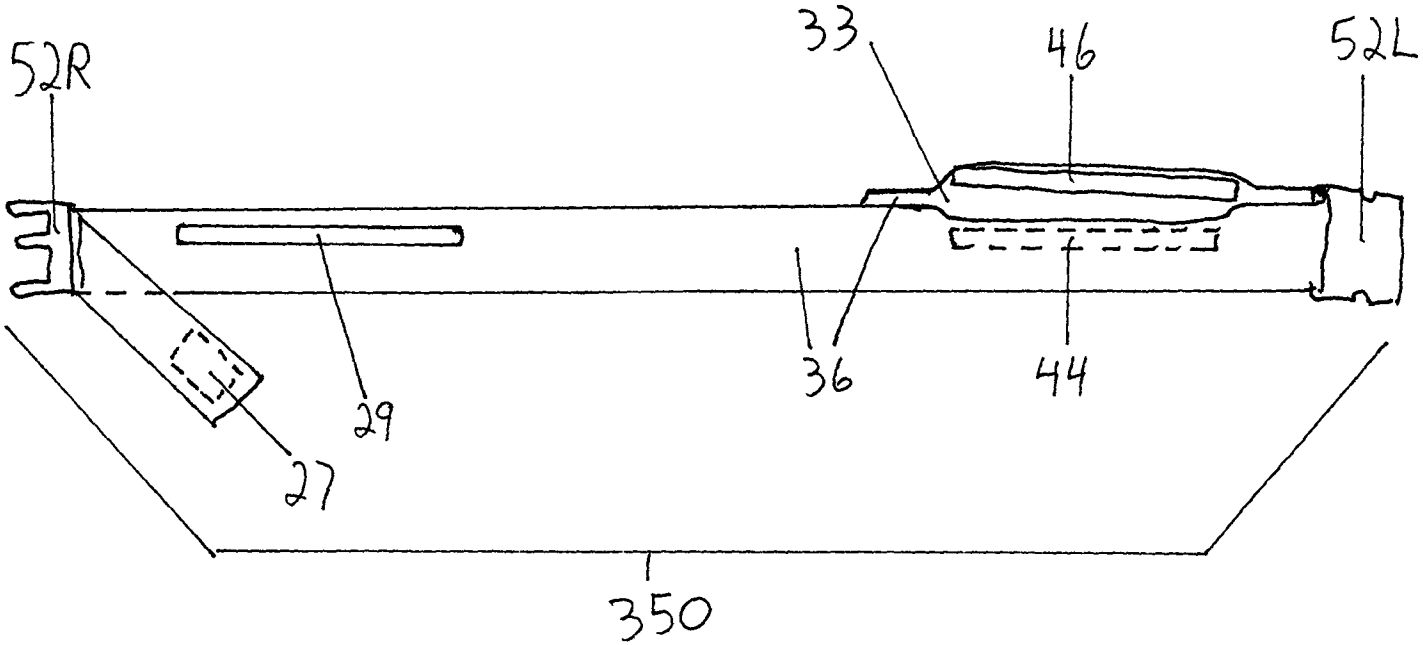
FIG. 11 is a front elevation view of the assembled preferred embodiment of waist belt shown in FIG. 10.

FIG. 11 shows assembled preferred embodiment of waist belt 350. Shown are buckle halves 52L and 52R. Hook and loop location 27 associates with hook and loop location 29. Hook and loop location 46 associates with hook and loop location 44 inside waist belt webbing 36 and functions to retain shapeable rigid inverted "T" frame assembly 21 (FIG. 1A) which is inserted into strap opening 33.

Figure 12:
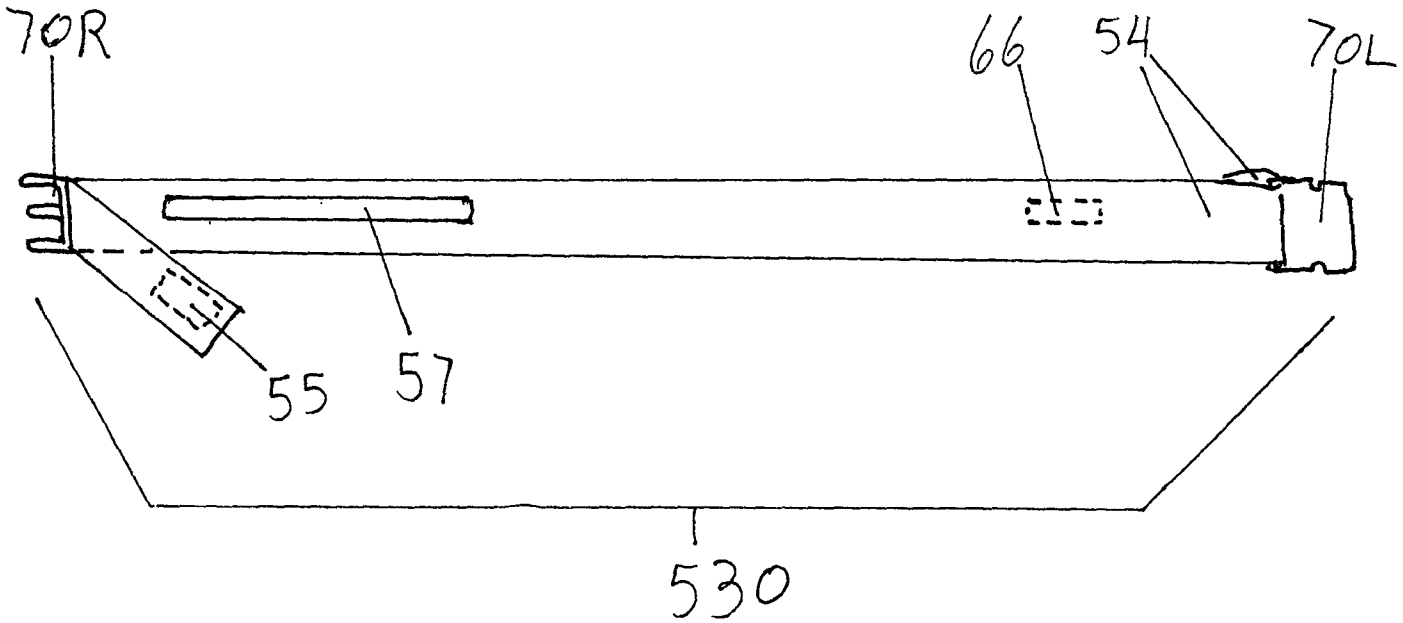
FIG. 12 is a front elevation view of the assembled preferred embodiment of the chest strap.

FIG. 12 illustrates preferred embodiment of chest strap 530. The chest strap as shown displays buckles 70R and 70L terminating chest strap 530 and logically are used to link chest strap into a circle around user's chest. Also shown are chest strap webbing 54 and hook and loop locations 55, 57, and 66.

Figure 13:
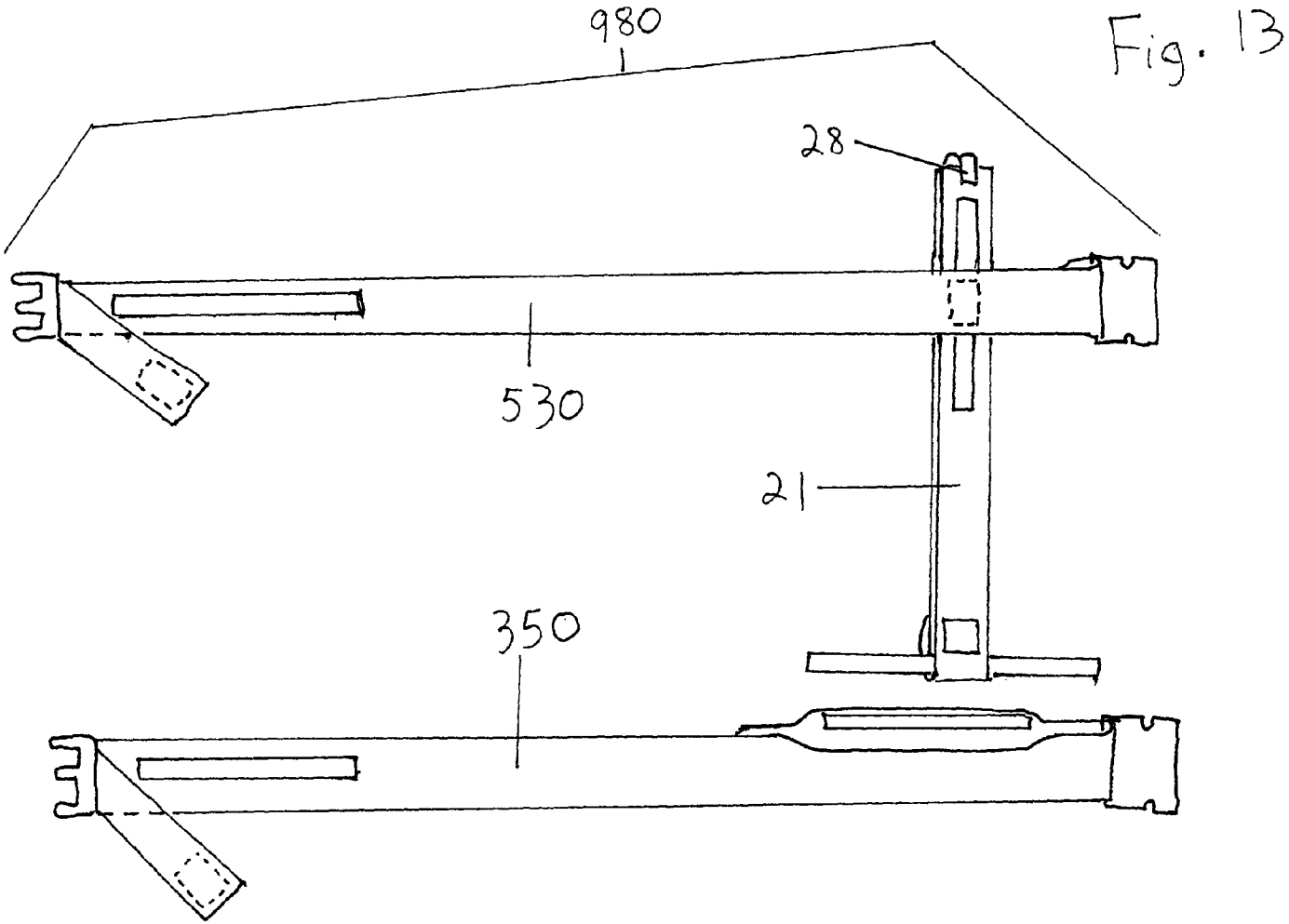
FIG. 13 is an exploded view of the preferred embodiment of the harness main assembly.

FIG. 13 shows components of preferred embodiment of harness main assembly 980 positioned for assembly. The three components shown are waist belt 350, padded rigid inverted "T" frame 21, and chest strap 530.

Figure 14:
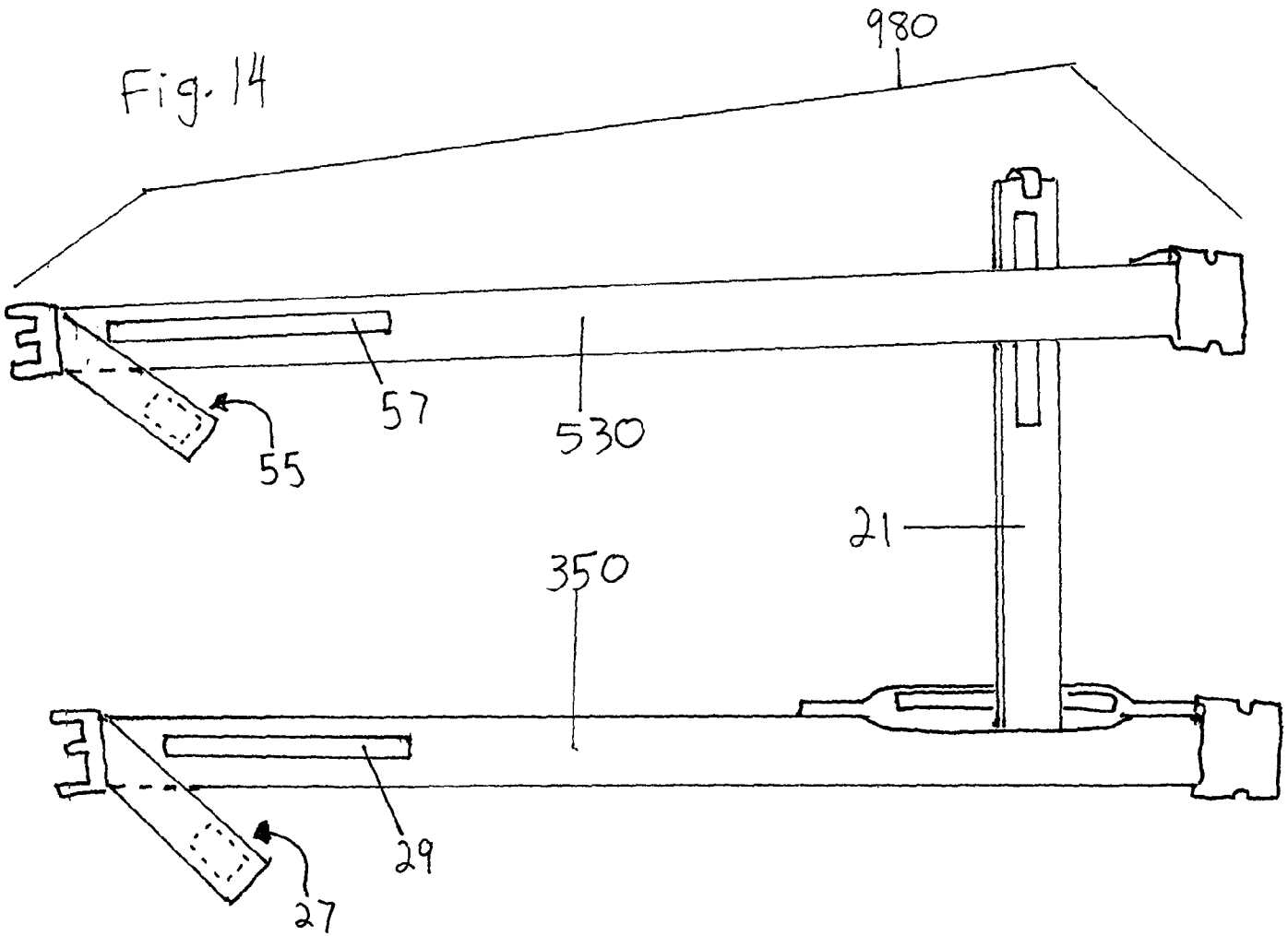
FIG. 14 is a front elevation view of the assembled preferred embodiment of the harness main assembly.

FIG. 14 shows assembled preferred embodiment of harness main assembly 980. The three components shown are waist belt 350, padded rigid inverted "T" frame 21, and chest strap 530.

As shown in FIG. 14 and FIG. 5C, to put the main harness assembly onto the body and use it to support a guitar, the user first puts the waist belt 350 around the waist and attaches the two parts of the buckle. The user would then adjust the fit of the belt by pulling the loose end of the webbing through the buckle. Next, by attaching the two hook and loop locations 27, 29 near the buckle the end of the webbing will be secured and will not hang loosely.

Then the user would put the chest strap 530 around the chest and attach the two buckle halves. Next, the user would adjust the fit of the chest strap in much the same way as the waist belt is adjusted.

As presented in FIG. 6B, the stringed instrument strap 73 is then threaded through the equipment strap loop adjustable 28 at the top of the inverted "T" frame. Next, hold the guitar in one hand and place the loops at either end of the stringed instrument strap onto the strap knobs 86, 88 on the guitar. Slide the loose end of the instrument strap webbing through the buckle 80 to adjust its length. Then, the guitar 90 can be placed and held in the desired playing position. The various vertical and horizontal adjustments can be made in several ways. The stringed instrument strap 73 and/or waist belt 350 can be lengthened or shortened to move the guitar vertically. Further, the hook and loop piece on the equipment loop strap adjustable 28 can be adjusted along the hook and loop piece on the back of the "T" frame, thus raising or lowering the stringed instrument strap and the guitar.

The stringed instrument strap 73 can be slid laterally through the "T" frame's equipment strap loop adjustable 28 to achieve the desired left-to-right positioning of the guitar. Also, the waist belt 350 and/or chest strap 530 can be rotated around the user's torso to further change the left-to-right positioning of the guitar. Lastly, the stringed instrument strap 73 can be slid through the equipment strap loop adjustable 28 either left or right. This changes the balance of the guitar, thus changing the angle of the guitar's neck relative to the horizontal axis. Guitarists generally have their favorite guitar positions and are reluctant to change these positions. The profound variety of guitar positions achievable by using the present invention/equipment support harness allows the user to place the guitar in any and all of these desired positions. The equipment support harness removes the instrument's weight from the user's back, shoulders and/or neck and places it instead on the waist and hips. The combination of these two aspects of the present invention make it a unique and superior device.

Although the present invention has been described with reference to preferred embodiments, numerous modifications and variations can be made and still the result will come within the scope of the invention. No limitation with respect to the specific embodiments disclosed herein is intended or should be inferred. Each apparatus embodiment described herein has numerous equivalents.

I claim:

1. A hip mounted support apparatus comprising:

an inverted T shaped frame having a horizontal member ranging in length from about four inches to about twelve inches, and having a vertical member ranging in length from about twelve inches to about twenty-four inches;

said horizontal member connected to a waist belt having a buckle to enable a user to firmly secure the waist belt around his waist with the vertical member aligned with a central axis of the user's chest;

a retainer secured to a top portion of the vertical member;

a chest belt connected to a top portion of the vertical member;

said chest belt having a buckle to enable the user to firmly secure the chest belt around his chest;

an instrument strap connected to the retainer so as to provide a mounting end emanating in each of a left and right direction from the retainer;

wherein the retainer is a loop, and the instrument strap is a guitar strap threaded through the loop, the guitar strap having a fastener on each end to support a guitar;

wherein the inverted T shaped frame has a front surface covered with padding;

wherein the chest belt connection to the top portion of the vertical member further comprises a hook and loop fastener;

wherein the waist belt and the chest belt each further comprises a webbing; and wherein the horizontal member connection to the waist belt further comprises a dual webbing sandwiching the horizontal member and the padding.

2. The apparatus of claim 1, wherein the dual webbing further comprises a hook and loop closure along a top edge to hold the webbings together, and the vertical member further comprises a hook and loop section to engage the top edge.

3. The apparatus of claim 2, wherein the vertical member is sandwiched between a pair of webbings.

4. The apparatus of claim 1, wherein the retainer loop further comprises a hook and loop fastener on a distal end of a webbing strap which is secured to the top portion.

5. The apparatus of claim 1, wherein each buckle further comprises an adjusting side release plastic buckle.

6. The apparatus of claim 1, wherein the inverted T shaped frame is rigid.

7. The apparatus of claim 6, wherein the inverted T shaped frame is made of flat metal bars welded together.

8. A hip mounted support apparatus comprising:

an inverted T shaped frame having a horizontal member ranging in length from about four inches to about twelve inches, and having a vertical member ranging in length from about twelve inches to about twenty-four inches;

said horizontal member connected to a waist belt having a buckle to enable a user to firmly secure the waist belt around his waist with the vertical member aligned with a central axis of the user's chest;

a retainer secured to a top portion of the vertical member;

wherein the retainer is a loop, and an instrument strap is a guitar strap threaded through the loop, the guitar strap having a fastener on each end to support a guitar;

a chest belt connected to a top portion of the vertical member;

said chest belt having a buckle to enable the user to firmly secure the chest belt around his chest;

an instrument strap connected to the retainer so as to provide a mounting end emanating in each of a left and right direction from the retainer;

wherein the waist belt and the chest belt each further comprises a webbing;

wherein the inverted T shaped frame is rigid;

wherein the inverted T shaped frame has a front surface covered with padding;

wherein the chest belt connection to the top portion of the vertical member further comprises a hook and loop fastener; and wherein the horizontal member connection to the waist belt further comprises a dual webbing sandwiching the horizontal member with the padding.

* * * * *